US005993255A

United States Patent [19]

Yurko

[11] Patent Number: 5,993,255

[45] Date of Patent: Nov. 30, 1999

[54] ELECTRICAL CONNECTOR WITH COMBINATION TERMINAL GUIDE AND TERMINAL POSITION ASSURANCE MEMBER

[75] Inventor: Garold Michael Yurko, Jamestown, N.C.

[73] Assignee: The Whitaker Corporation, Wilmington, Del.

[21] Appl. No.: 08/992,046

[22] Filed: Dec. 17, 1997

[51] Int. Cl.[6] ..... H01R 13/40

[52] U.S. Cl. ..... 439/595; 439/364

[58] Field of Search ..... 439/362–364, 439/594–598, 752

[56] References Cited

U.S. PATENT DOCUMENTS

| | | | |
|---|---|---|---|
| 4,797,116 | 1/1989 | Isohata et al. | 439/141 |
| 5,071,369 | 12/1991 | Denlinger et al. | 439/595 |
| 5,127,854 | 7/1992 | Fujitani et al. | 439/595 |
| 5,160,279 | 11/1992 | Sagawa et al. | 439/595 |
| 5,501,606 | 3/1996 | Oda et al. | 439/140 |
| 5,520,553 | 5/1996 | Cecil, Jr. et al. | 439/595 |

*Primary Examiner*—Khiem Nguyen

[57] ABSTRACT

An electrical connector assembly includes a high density plug connector 2 that is mated to a high density receptacle connector 4, each of which can be attached to wires 76. The plug connector includes male terminals 18 held in cavities 10 by resilient latches 12. The plug connector also includes a combination terminal guide and terminal position assurance member 26 which both guides and aligns male terminals 18 during mating and engages the resilient latches 12 to be sure that all of the terminals 18 are properly inserted in the plug connector housing 4. The male TPA guide member 26 is mounted on the plug connector housing mating face 6 and includes a front panel 28 with openings 30 for guiding the male terminals 18 during mating. Projections 32 extend from the panel 28 and function as terminal position assurance members.

20 Claims, 5 Drawing Sheets

Fig. 2
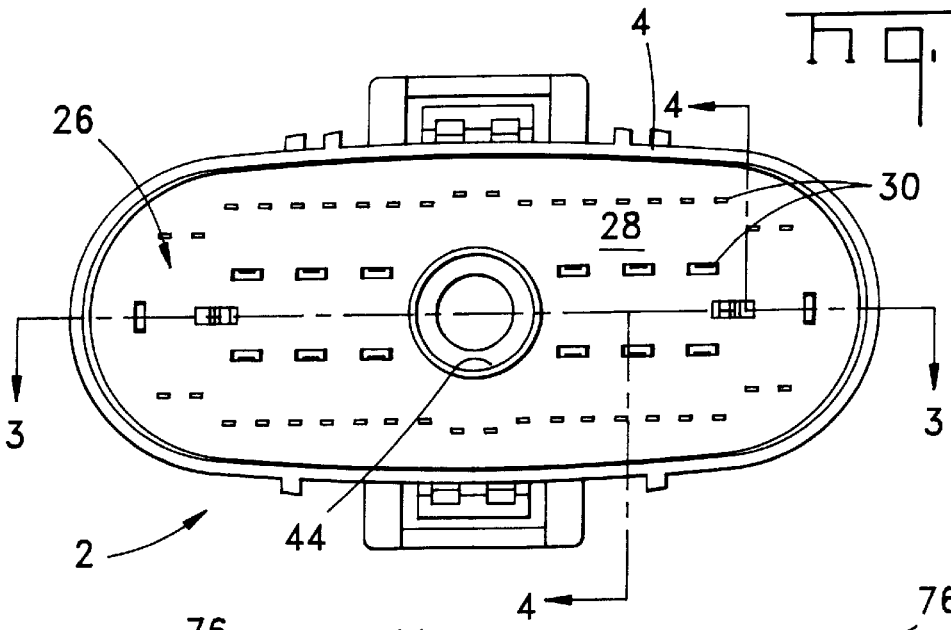
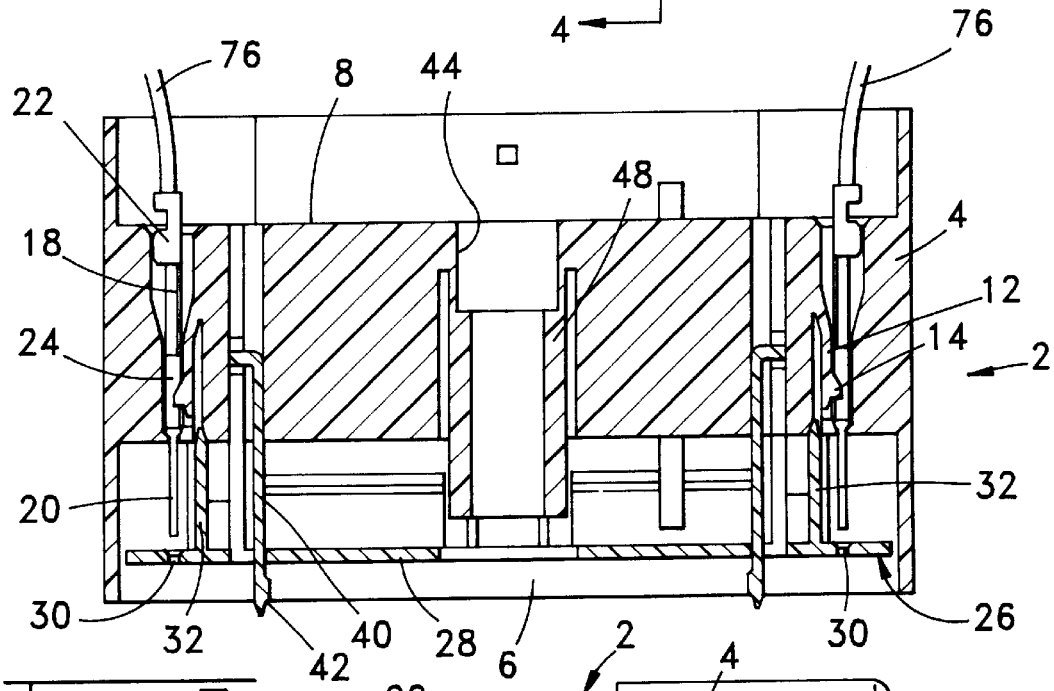
Fig. 3
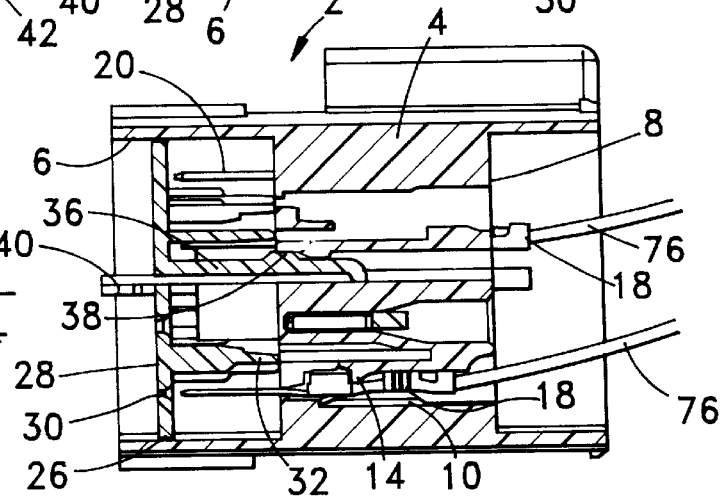
Fig. 4

ELECTRICAL CONNECTOR WITH COMBINATION TERMINAL GUIDE AND TERMINAL POSITION ASSURANCE MEMBER

BACKGROUND OF THE INVENTION

1. Field of the Invention

This invention is related to electrical connectors that employ terminal position assurance members to insure that all terminals are properly positioned in a connector housing. This invention also relates to electrical connectors that employ guiding members to guide and align male terminals during mating.

2. Description of the Prior Art

Terminal position assurance members (TPA) are commonly used on electrical connectors, especially on electrical connectors used in the automotive industry. A terminal position assurance member is a movable member that can be moved into its proper position only if all of the terminals in the connector are in their fully inserted position. A variant of a terminal position assurance member is a terminal position assist member, which moves the terminals into a completely inserted position. Either form can also back up or prevent disengagement of a latches that hold terminals in an electrical connector housing.

In applications, such as automotive applications, individual electrical connectors can include many terminals attached to wires in a harness. The electrical connector used in these applications is commonly used on a receptacle connector, or a connector that includes female or socket terminals, that are connected to a pin header including printed circuit board pins. In these applications, a terminal position assurance member is commonly used with the receptacle connector. A terminal position assurance member used with a receptacle connector can be mounted on the mating face of the connector. The front mounted TPA can include a front panel with openings and projections, extending from the front panel into a terminal position assurance position beside the housing latches securing the terminal in the housing. Pins in the mating header enter the mating face of the receptacle connector through openings in the front mounted TPA. A TPA of this type can be used on a male or plug connector when two cables are to be attached.

Although in many applications, only the female electrical connector employs a TPA, a TPA is also employed in male electrical connectors when both the male and female electrical connector employs crimp snap terminals to connect wires extending from two or more harnesses into both of the mating connectors.

In many motor vehicle and other applications, a large number of wires must be connected in densely packed connectors containing a large number of terminals. In such applications a relative high mating force is required. Often one connector includes a bolt and the other includes a nut to provide mechanical assistance for overcoming these high mating forces. In certain densely populated prior art connectors pin guides are used to align pins during mating to prevent stubbing and damage to the terminals. These pin guides can also serve as pin protectors to prevent damage to the terminals during shipping.

Although each of these separate features is employed in prior art electrical connectors there is still the problem of including all of these desirable features is a densely populated assembly. In applications, such as motor vehicles, size and space are not unlimited and a large number of features must often be included within a relatively small electrical connector assembly.

SUMMARY OF THE INVENTION

The instant invention includes a large number of required features within a relatively small densely populated electrical connector assembly. According to this invention, a high density electrical connector plug is matable with an electrical connector receptacle, and the force necessary to mate the first connector to the second connector is developed by a mechanical assist device for joining the first electrical connector to the second electrical connector. The first plug electrical connector has a housing and a plurality of male terminals insertable into cavities in the housing through a rear face of the housing. The terminals are retained in the housing cavities by resilient latches extending into thee housing cavities. The resilient latches are deflectable to permit insertion of the male terminals into the housing and return to an extended position to engage fully inserted terminals and to latch the male terminals in the housing cavities. The first electrical connector plug includes a combination terminal guide and terminal position assurance member or male TPA guide member located on a mating face of the electrical connector plug. This male TPA guide member is shiftable from an extended terminal protection position to a mated locking position as the electrical connector plug is mated to electrical connector receptacle by the mechanical assist device. The combination terminal guide and terminal position assurance member comprises a panel with openings, through which the male terminals extend for guiding the male terminals during mating. The ends of the terminals when positioned in the panel openings will also be protected by the combination terminal guide and terminal position assurance member. Projections extend from the panel and are insertable behind the resilient latches to assure that the terminals are fully inserted in the housing cavities.

BRIEF DESCRIPTION OF THE DRAWINGS

FIG. 2 is a front view of the electrical connector plug shown in FIG. 1.

FIG. 3 is a section view taken along section lines 3—3 in FIG. 2 with the male TPA guide in an initial position prior to movement to either a terminal protection position or a locked position.

FIG. 4 is a section view taken along section lines 4—4 in FIG. 2 showing the male TPA guide in the same position as in FIG. 3.

DETAILED DESCRIPTION OF THE PREFERRED EMBODIMENT

Figure 1:
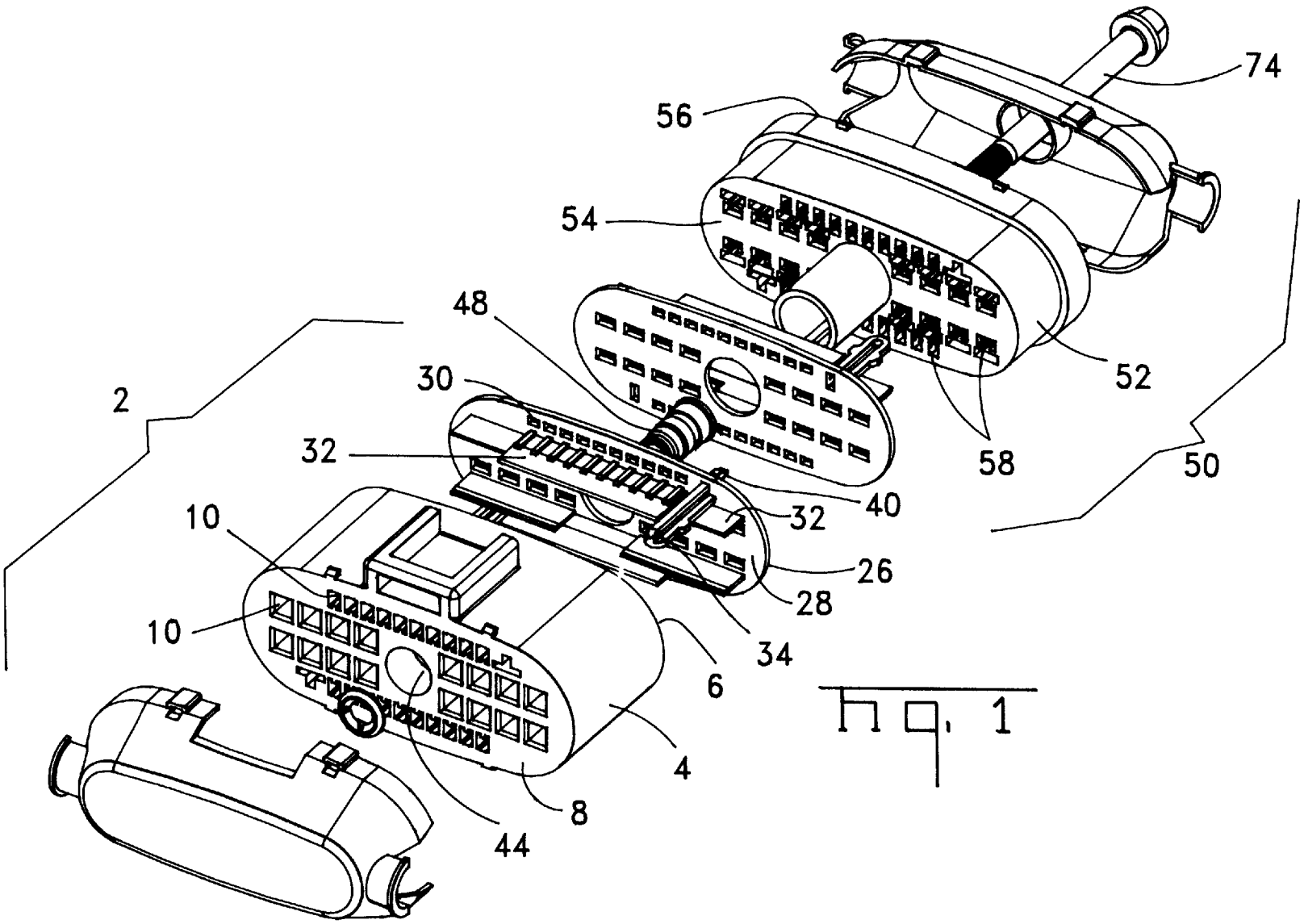
FIG. 1 is an exploded perspective view of an electrical connector plug including a housing, terminals and a combination male terminal guide and terminal position assurance member, together with a mating female or receptacle connector.

The connector assembly comprising the preferred embodiment of this invention includes a first plug electrical connector 2 that is matable with a second receptacle electrical connector 50. This connector assembly is used to connect wires 76 in two wiring harnesses and would normally be employed in a motor vehicle. Both that plug connector 2 and the receptacle connector 50 are densely populated connectors that are intended to connect a large number of wires within a relatively small volume. Space and size are therefore significant considerations. The preferred embodiment of this connector assembly is intended to connect both 10 AWG wires and 20 AWG wires. Therefore terminals of different sizes are used in both connectors. Only the smaller of the terminals are illustrated in the drawings, but the manner in which the larger terminals are secured in respective housings and the manner in which the larger male terminals are guided during mating is the same.

The electrical connector plug 2 comprises a plug housing 4, a plurality of male terminals 18 in the form of pins or blades, and a locking member 26 that comprises a combination male terminal guide and protector plus a terminal position assurance member (TPA). The female connector receptacle 50 also comprises a receptacle housing 52, female terminals 64 and a terminal position assurance member 72. Because of the large number of male terminals 18 and female terminals 64 that are mated, and the relatively large mating force, mechanical assist means in the form of a bolt 74 and a nut 48 are employed to bring the two connectors into fully mated engagement.

The electrical connector plug housing 4 is molded from a conventional engineering thermoplastic, such as PBT, and comprises a one piece member. Housing 4 includes a rear face 6 and a front or mating face 6 with a plurality of plug housing cavities 10 extending between the rear and mating faces. The housing also includes resilient latches 12 that extend into each housing cavity 10 and hold male terminals 18 in individual housing cavities 10. Only the small cavities 10 are illustrated in detail, but the same construction is used for the larger cavities 10. In the preferred embodiment, the resilient latches 12 comprise integral parts of the housing 4 that are small enough to be deflectable to permit insertion of a male terminal 18 through the rear face 8, past the resilient latch 12 and into a fully inserted position. Each latch 12 includes a protruding latching boss 14 that engages the corresponding male terminal 18. A gap on the rear of each latch 12 provides clearance for the latch 12 to deflect to permit the corresponding terminal 14 to pass the latching boss 14. When the terminal 14 is fully inserted, the latch 12 returns to its normal latching position. The housing cavities 12 are generally located in multiple rows, and grooves 16 extend between housing cavities 12 for substantially the entire length of the rows.

The male terminals 18 employed in plug connector 2 are conventional stamped and formed male terminals. Again only the smaller terminals are illustrated herein, but the larger male terminals are also conventional stamped and formed terminals. Each of the male terminals 14 includes a mating section 20 at the distal or forward end of the terminal and a conventional wire crimp section 22 located at the rear of the terminal. A terminal retention section 24 located between the mating section 20 and the wire crimp 22 includes a hole for receiving the protruding latching boss 14 when the terminal 14 is fully inserted into its appropriate housing cavity 10.

Figure 5:
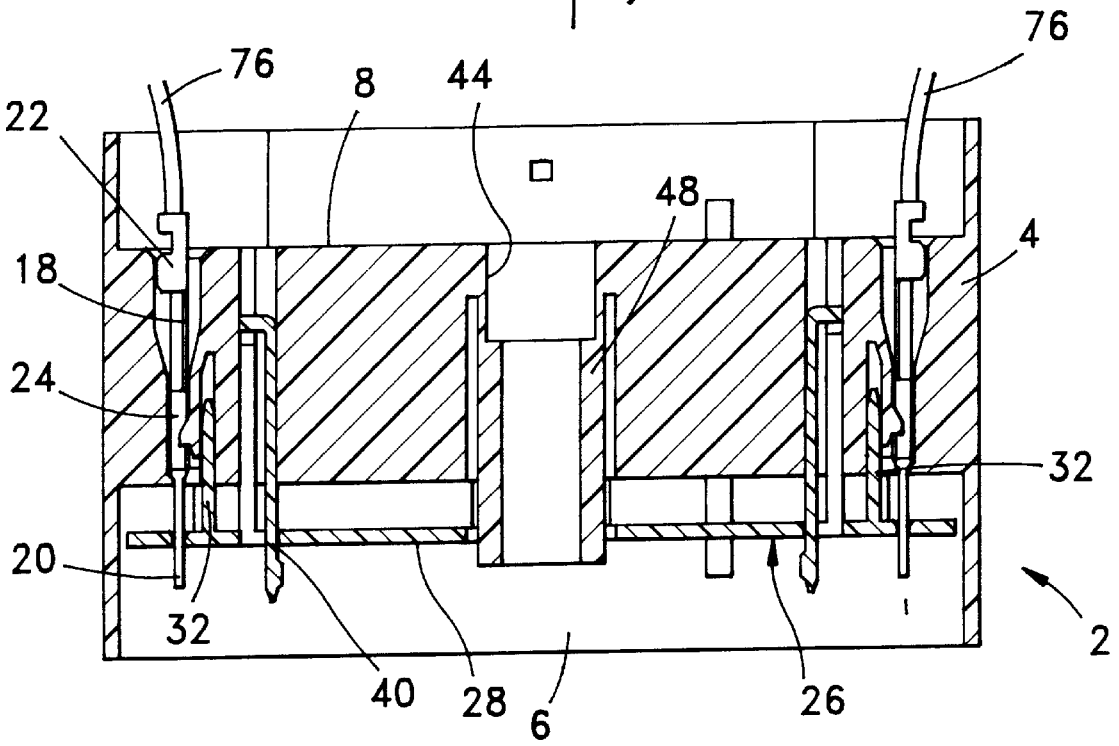
FIG. 5 is a view similar to FIG. 3 showing the male TPA guide in the extended terminal protection position.
Figure 6:
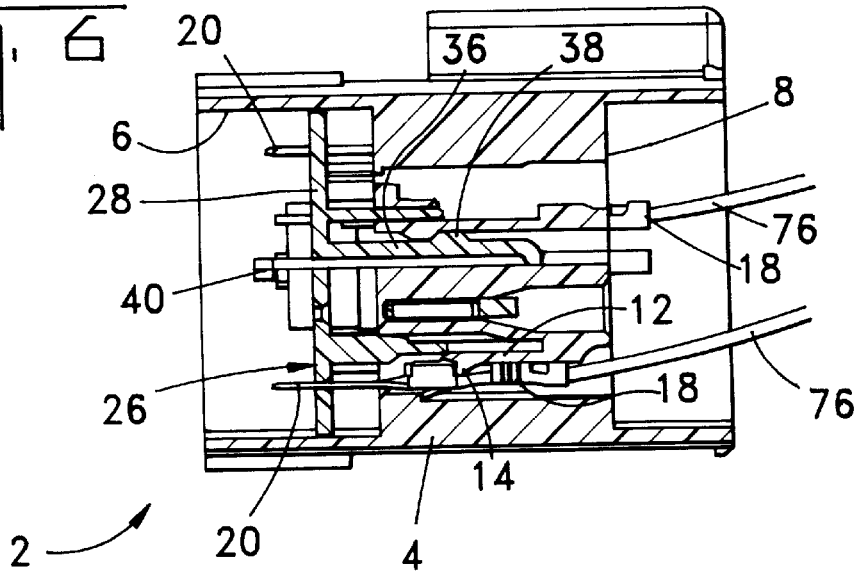
FIG. 6 is a view similar to FIG. 4 showing the male TPA guide in the same position as in FIG. 5.

Electrical connector plug 2 also includes a combination terminal guide and TPA member 26 that is located on the mating face 6 of the connector housing 4. The male TPA guide member 26 is shiftable when the plug connector 2 is mated with the receptacle connector 50, and is molded from a conventional engineering thermoplastic, such as PBT. The male TPA guide member 26 includes a panel 28 that extends parallel to the mating face 6 of plug housing 4 and substantially covers the mating face. Panel 28 includes a plurality of openings 30, each located in alignment with a corresponding housing cavity 10. A plurality of projections 32 in the form of substantially flat plates or tongues extend from the interior surface of panel 28, substantially perpendicular to the panel 28 and beside panel openings 30. The panel openings 30 are dimensioned so that the distal or mating end 20 of terminals 4 can extend through corresponding panel openings 30 so that the openings comprise means for guiding the terminals 4 to keep them in proper position to be mated with the receptacle terminals 64 in the connector receptacle 50. With the distal ends 20 only protruding through the panel openings 30 as shown in FIGS. 5 and 6, the panel 28 also serves as a pin protector preventing damage to the male terminals 4. The projections 32 comprise terminal position assurance means that fit in the gaps behind corresponding resilient terminal latches 12 of a properly seated terminal 18 when the two electrical connectors are fully mated. Since the projections 32 extend laterally parallel to rows of terminal 4 and housing cavities 10, the projections are also dimensioned to fit within grooves 16 extending between adjacent housing cavities 10 in a single row.

The male TPA guide member 26 is retained on the plug housing 4 by two latching fingers 34 located on opposite sides of the male TPA guide member 26. The latching fingers 34 include resilient beams 36 with a protrusion 38 that engages a shoulder on the plug housing 2 to retain the male TPA member 26 on the plug housing 4. Although the male TPA member 26 is retained on the plug housing 4, it is still shiftable between an extended terminal protection position and a fully mated locking position. During movement of the male TPA guide member 26, it guides the mating ends 20 of male terminals 18 so that the terminals will be properly aligned for mating and will not stub or be damaged. The latching fingers 34 also include a release arm 40 that extends from the front or exterior face of the panel 28. Release arm 40 includes a release arm protrusion 42 that is used to move the male TPA guide member 26 from the locking position to the terminal protection position as the plug connector 4 is unmated from the receptacle connector 50.

Both the plug housing 4 and the male TPA guide member 26 include an hole 44 to receive a mechanical assist nut 48. This nut 48 is trapped within the plug housing 4, and rotation of the bolt 74 mounted on the receptacle connector 50 provides the necessary mechanical assist to mate the two halves of the connector assembly.

The receptacle connector 50 includes a receptacle connector housing 52 that is configured to mate with the plug connector housing 4. Female, receptacle or socket terminals 64 are mounted in housing 52 to mate with corresponding male terminals 18 in the plug connector 4. Again two terminal sizes are used in this connector 50. Each female or receptacle terminal includes a mating or socket section 66 and a wire crimp section 68 with a retention section 70 located in the middle portion of the terminal.

The receptacle connector housing 52 is also a molded housing, that is preferably fabricated from the same material as the plug housing 4. Receptacle housing 52 has a mating face 54 and a rear face 56 with housing cavities 58 extending between opposite faces. Receptacle terminals 64 are inserted into the receptacle housing 52 through the rear face 56 and resilient latches 60 retain the terminals 64 in cavities 58 in the same manner that the male terminals 18 are secured by resilient latches 12. Receptacle connector 50 also includes a terminal position member 72 that secures the receptacle housing latch 60 in engagement with a fully inserted receptacle terminal 64. The receptacle TPA 72 is mounted on the front of the receptacle housing 52 and also includes an opening through which male terminals 18 enter to mate with the female receptacle terminals 64. However, the receptacle TPA is not shiftable during mating and unmating.

The operation of the male TPA guide 26 functioning both as a guiding member for the male terminals 18 and as a terminal position assurance member for the male terminals 18 is shown in three positions in FIGS. 3–8. FIGS. 3 and 4 show an initial position just prior to insertion of the male TPA guide 26 into engagement with the plug housing 4. This position shows one latching finger protrusion 42 just prior to engagement with a retaining shoulder on the side of a slot into which the latching finger 34 is to be inserted. In this position, the resilient latches 12 are also free to deflect to permit insertion of male terminals 18 into housing cavities 10. The TPA projections 30 have not yet moved into a position behind the resilient latches 12. The plug connector can be shipped in this position.

FIGS. 5 and 6 show the male TPA guide member 26 in the terminal protection position in which the distal or mating ends 20 have entered corresponding openings 30 in the panel section 28 of male TPA guide member 26. In this and succeeding position the openings 30 keep the terminals 18 aligned with the receptacle terminals 64 in the mating connector. In this position the latching finger protrusion 42 has snapped over the companion shoulder on the plug housing 4 so that the male TPA guide member cannot be removed, although it is still free to shift between the terminal protection position shown in FIGS. 5 and 6 and the locking position shown in FIGS. 7 and 8. Although the projections 32 are not yet fully inserted behind the resilient latches 12, there is some initial interference and if one or more of the terminals 18 is not fully inserted, the corresponding projection 32 will abut the end of the deflected resilient latch 12. Therefore the male TPA guide member 26 cannot be moved into the position shown in FIGS. 7 and 8 if only one terminal is partially inserted and the corresponding latch 12 has not resumed its normal position providing room for the projection or tongue 32. When the terminal 18 is not fully inserted, either it will no longer be possible to force the two connectors together or the partially inserted terminal will be forced out of the rear of the plug housing 4.

Figure 7:
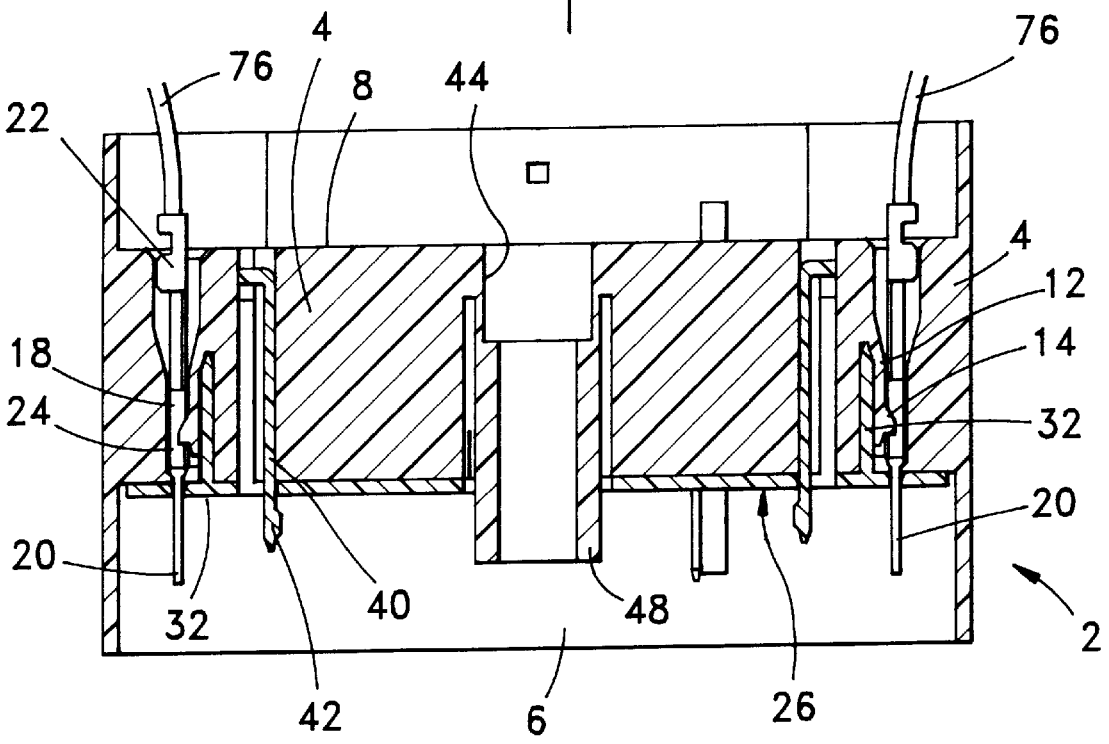
FIG. 7 is a view similar to FIG. 3 showing the male TPA guide in the fully mated locked position.
Figure 8:
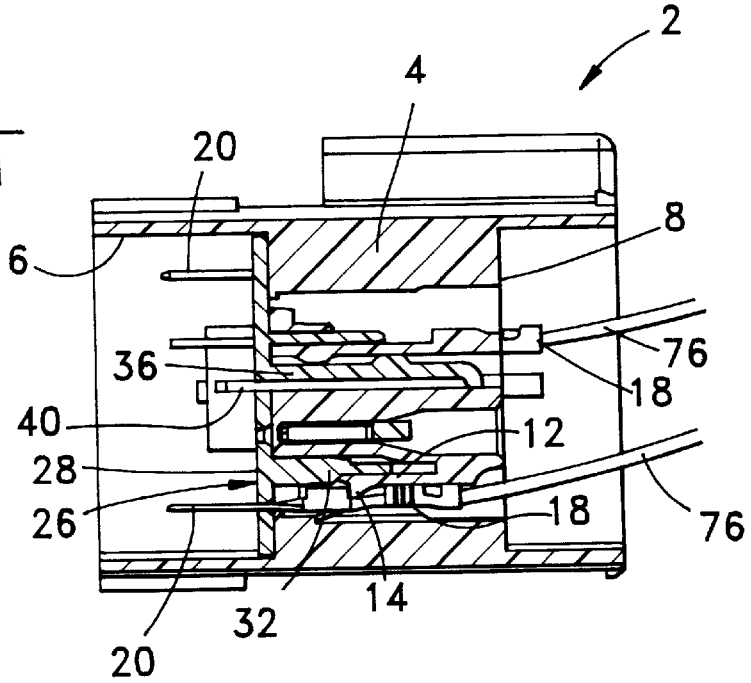
FIG. 8 is a view similar to FIG. 4 showing the male TPA guide in the same position a FIG. 7.

The locking or fully mated position of the male TPA guide member 26 is shown in FIGS. 7 and 8. In this position the male terminals 18 which protrude beyond the panel 28 will be mated with the receptacle terminals in the mating receptacle connector 50. The TPA projections 32 have moved behind the resilient latches 12 which therefore cannot be deflected even by a large force applied to the terminals 18 or the wires 76 attached to these terminals. If the two connectors are unmated, the release arm protrusion 42 which engages the receptacle TPA 72, will cause the male TPA guide member 26 to be pulled from the locking position of FIGS. 7 and 8 to the terminal protection position of FIGS. 5 and 6. When the connectors are again mated, the male TPA guide member can again move from the guiding to the locking position, again performing its terminal protection and guide function.

Figure 9:
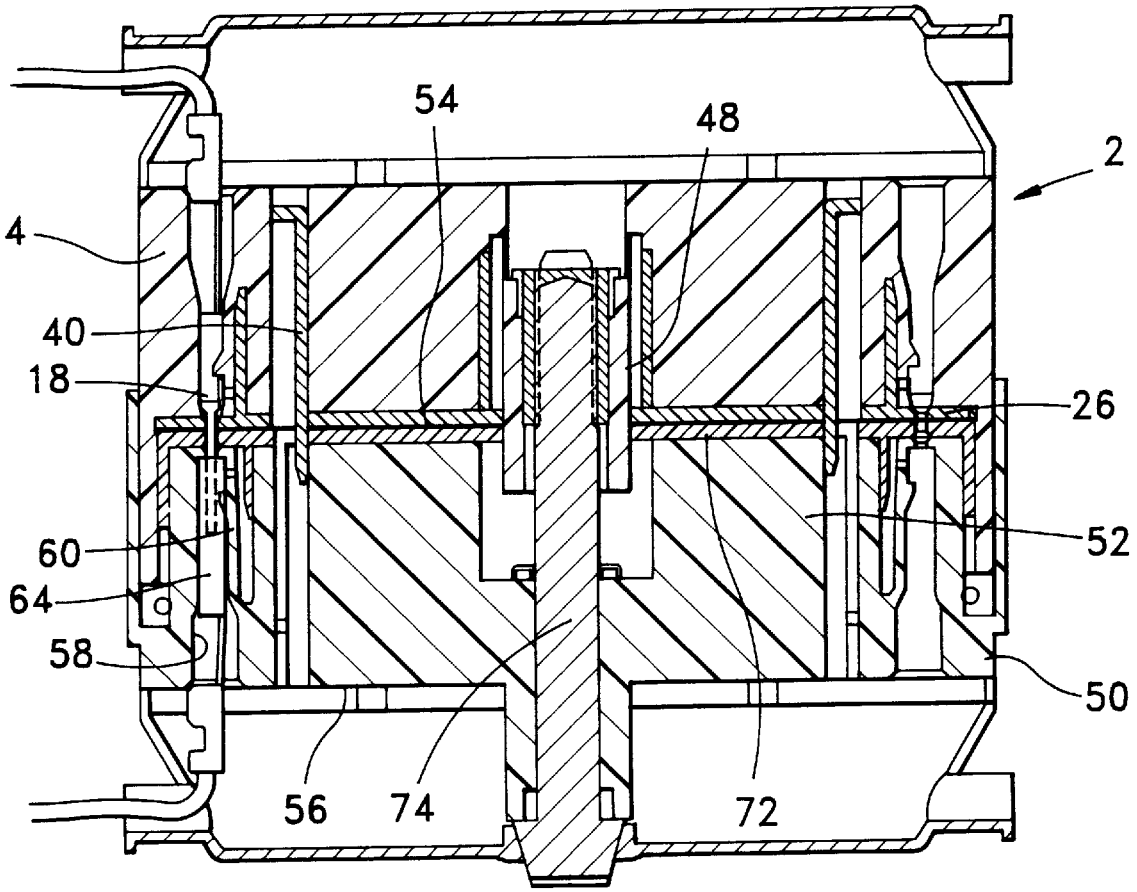
FIG. 9 is a section view of the connector assembly including the plug and receptacle connectors.

FIG. 9 is a section view showing the two connectors in the fully mated position. The action of the bolt 74 and nut 48 which provides mechanical assist during mating and can also be used to unmate the connector assembly can be seen from this view. The engagement of the front face of the male TPA guide member 26 with the female TPA 72 pushing the male TPA guide member 26 from the guiding to the locking position is also apparent from this view.

The preferred embodiment depicted herein comprises only a representative embodiment of this invention. Equivalent embodiments would be apparent to one of ordinary skill in the art. For example, separate metal latches could be substituted for the molded resilient latch latches of the preferred embodiment. This invention could also be employed in a sealed connector and the number of location of the terminals and housing cavities could also be varied. Other alternatives could include the use of a mechanical assist means other than the bolt and nut used herein, and in its broadest aspects, the male TPA guide member could be employed in an electrical connector that did not require any mechanical assist to overcome the contact mating forces. This invention could also be used for connectors using round pins and sockets instead of flat blades or pins. Therefore the invention is defined in terms of the following claims and is not limited to the representative preferred embodiment depicted herein.

I claim:

1. An electrical connector plug matable with an electrical connector receptacle, the plug including a housing having a mating face, male electrical terminals extending beyond the mating face and retained in housing cavities by resilient latches engaging the male terminals, and a locking member, the locking member including a flat front panel substantially covering the housing mating face with openings aligned with the housing cavities through which the terminals extend, the locking member also including projections extending into the housing cavities, the locking member being shiftable between a terminal protection position and a locking position, the panel and openings comprising means for protecting and guiding the male terminals during mating and the projections comprising means for securing the resilient latches in engagement with the terminals.

2. The electrical connector plug of claim 1 wherein the projections comprise planar tongues extending between adjacent cavities.

3. The electrical connector plug of claim 2 wherein the housing includes grooves extending between adjacent cavities, the planar tongues being received in aligned grooves.

4. The electrical connector plug of claim 1 wherein the locking member includes a latching finger extending from the panel into a latching slot extending inwardly from the mating face of the housing.

5. The electrical connector plug of claim 4 wherein the latching finger secures the locking member to the housing with the locking member being free to move between the terminal protection position and locking positions.

6. The electrical connector plug of claim 1 wherein housing cavities are located in multiple rows, each projection being insertable between rows into the locking position.

7. The electrical connector plug of claim 6 wherein the housing includes a groove extending between housing cavities in the same row, a single projection being insertable into multiple cavities in the same row and into the groove extending between housing cavities in the same row.

8. The electrical connector plug of claim 1 wherein the locking member comprises a terminal position assurance member which is shiftable to the locking position only after all male terminals are fully inserted into the housing cavities so that the resilient latches provide clearance for the projections in the locking position.

9. The electrical connector plug of claim 1 wherein the locking member is shiftable from the terminal protection position to the locking position when the electrical connector plug is mated with the electrical connector receptacle.

10. The electrical connector plug of claim 9 wherein the plug includes one of a bolt or a nut matable with a nut or bolt respectively in the mating electrical connector receptacle, the nut and bolt comprising means for moving the electrical connector plug and the electrical connector receptacle into a fully mated position, and means for moving the locking member from the terminal protection position to the locking position.

11. An electrical connector assembly comprising:

a first electrical connector including a first housing and a plurality of male terminals received within first housing cavities, multiple male terminals being located in multiple rows;

a second electrical connector including a second housing and a plurality of female terminals received within second housing cavities, multiple female terminals being located in multiple rows for mating with the male terminals in the first electrical connector;

a bolt and a nut for mating the first electrical connector to the second electrical connector; and a combination male terminal guide and terminal position assurance member on the first connector including openings through which the male terminals are progressively received to guide the male terminals as the bolt and nut bring the first electrical connector into fully mated engagement with the second electrical connector and terminal position assurance projections movable into position beside male terminals fully inserted into the first housing cavities.

12. The electrical connector assembly of claim 11 wherein the combination male terminal guide and terminal position assurance member is located on a mating face of the first electrical connector.

13. The electrical connector assembly of claim 11 wherein the combination male terminal guide and terminal position assurance member comprises a panel with projections extending from the panel.

14. The electrical connector assembly of claim 13 wherein the openings extend through the panel in alignment with the first housing cavities.

15. The electrical connector assembly of claim 14 wherein the nut is retained within the first electrical connector and a bolt clearance hole extends through the panel.

16. The electrical connector assembly of claim 13 wherein the projections comprise a series of plates extending between rows of terminals.

17. The electrical connector assembly of claim 16 wherein the male terminals are held in the first housing cavities by resilient latches comprising extensions of the first housing, the latches being located between the terminal and adjacent plates when the first electrical connector is fully mated with the second electrical connector if all of the terminals are properly positioned within the first housing cavities.

18. A high density first electrical connector matable with a second electrical connector in which the force necessary to mate the first connector to the second connector requires a mechanical assist device for joining the first electrical connector to the second electrical connector, the first electrical connector comprising a housing and a plurality of male terminals insertable into cavities in the housing through a rear face of the housing, the terminals being retained in the housing cavities by resilient latches extending into the housing cavities, the resilient latches being deflectable to permit insertion of the male terminals into the housing and returning to an extended position to engage fully inserted terminals and to latch the male terminals in the housing cavities, the first electrical connector including a combination terminal guide and terminal position assurance member located on a mating face of the first electrical connector and shiftable from an extended terminal protection position to a mated locking position as the first electrical connector is mated to the second electrical connector by the mechanical assist device, the combination terminal guide and terminal position assurance member comprising a panel with openings, through which the male terminals extend, comprising means for guiding the male terminals during mating, and projections extending from the panel and insertable behind the resilient latches, comprising means for assuring that the terminals are fully inserted in the housing cavities.

19. The first electrical connector of claim 18 wherein the mechanical assist device comprises a bolt and nut, one of the bolt and nut being mounted in the first electrical connector.

20. The first electrical connector of claim 18 wherein the combination terminal guide and terminal position assurance member includes a release finger extending beyond the panel, releasably engagable with the second connector to move the combination terminal guide and terminal position assurance member from the locking position to the terminal protection position when the connectors are unmated.

* * * * *